United States Patent [19]

Dahrendorf et al.

[11] Patent Number: 4,840,170

[45] Date of Patent: Jun. 20, 1989

[54] SELF-RESCUER APPARATUS

[75] Inventors: Klaus-Dieter Dahrendorf; Volker Huennebeck; Wilfried Hoffman, all of Berlin, Fed. Rep. of Germany

[73] Assignee: Auergesellschaft GmbH, Berlin, Fed. Rep. of Germany

[21] Appl. No.: 72,526

[22] Filed: Jul. 13, 1987

Related U.S. Application Data

[63] Continuation-in-part of Ser. No. 824,775, Jan. 30, 1987, abandoned.

[30] Foreign Application Priority Data

Feb. 2, 1985 [DE] Fed. Rep. of Germany ..... 3503628

[51] Int. Cl.[4] ..... A62B 7/08

[52] U.S. Cl. ..... 128/202.26; 128/204.15; 128/205.12; 128/205.28

[58] Field of Search ..... 128/132 R, 202.19, 202.13, 128/202.26, 201.15, 201.16, 205.12, 205.22, 205.28; 224/216, 261, 907

[56] References Cited

U.S. PATENT DOCUMENTS

| | | | |
|---|---|---|---|
| 3,580,250 | 5/1971 | Orozu | 128/202.26 |
| 3,607,122 | 9/1971 | Hwoschinsky | 128/202.28 |
| 3,650,269 | 3/1972 | Curtis | 128/205.12 |
| 4,253,454 | 3/1981 | Warneke | 128/202.26 |
| 4,294,244 | 10/1981 | Pasternack | 128/202.26 |
| 4,334,533 | 6/1982 | Henkin | 128/205.28 |
| 4,491,130 | 1/1985 | Pasternack | 128/202.21 |

FOREIGN PATENT DOCUMENTS

| | | | |
|---|---|---|---|
| 583693 | 2/1928 | Fed. Rep. of Germany | 128/202.26 |
| 0013709 | 6/1956 | Fed. Rep. of Germany | 128/205.22 |
| 1132802 | 7/1962 | Fed. Rep. of Germany | 128/202.26 |
| 1234133 | 2/1967 | Fed. Rep. of Germany | 128/202.26 |
| 1813143 | 6/1970 | Fed. Rep. of Germany | 128/202.26 |
| 2649067 | 5/1978 | Fed. Rep. of Germany | 224/210 |
| 2854265 | 6/1980 | Fed. Rep. of Germany | 128/202.26 |
| 0051297 | 9/1941 | Netherlands | 128/205.12 |
| 0023654 | 10/1912 | United Kingdom | 128/204.15 |
| 0624774 | 6/1949 | United Kingdom | 128/202.26 |
| 1170702 | 11/1964 | United Kingdom | 128/205.22 |

*Primary Examiner*—Edward M. Coven
*Assistant Examiner*—K. M. Reichle
*Attorney, Agent, or Firm*—Reed Smith Shaw & McClay

[57] ABSTRACT

The invention is a spacer of a respirator bag to be carried in front of the chest. Inside the respirator bag an oxygen producing chemical cartridge is positioned. On the outside of the respirator bag facing the body of the carrier, a spacer body open at its top and bottom, is positioned as a spacer between the carrier and respirator bag.

4 Claims, 3 Drawing Sheets

SELF-RESCUER APPARATUS

This is a continuation-in-part of U.S. patent application Ser. No. 06/824,775, filed Jan. 31, 1987, now abandoned.

FIELD OF THE INVENTION

The present invention pertains to a respirator as an oxygen self-rescuer.

BACKGROUND OF THE INVENTION

Respirators of the type indicated above are housed in stand-by containers which can be closed airtight and are used, for example, by miners who carry them constantly on their bodies. The device is removed from the stand-by container for use.

In a known respirator of the general type depicted here, the respirator bag is located above the chemical cartridge, and the cartridge is placed in the lower part of the housing; the respirator bag with its breathing hose and mouthpiece are located in the upper housing cover. The respirator, together with its stand-by container must be worn on the body by means of a shoulder strap.

With such a breathing apparatus, (where the respirator bag is carried in front of the chest), the temperature increases during breathing because of the sensible heat of reaction from conversion of the contained oxygen-producing chemical.

The management of the surface temperature of the chemical canister is vitally important for the reason that during the breathing transient, short-duration temperatures as high as 250° C. can be reached. The buildup of temperature between the back surface of the respirator and the abutting chest of the user of the device can cause inflammation and other skin irritations, which are a plainly unacceptable side effect. It almost goes without saying that such risks must be controlled in order that the user does not burn himself as a side effect. One solution to reducing this risk is described in Austrian Pat. No. 87,667, Sept. 15, 1921.

British Pat. 1,170,702 to Drager, teaches a portable respiratory apparatus. The apparatus is worn on the back of a user and includes a chemical container that processes exhaled breath into oxygen, a breathing bag and an oxygen bottle. A second container situated between the first container and the user holds coolant which cools the first container. In addition there are tubes which extend down from the second container along the back of the user that allows the coolant to flow through to provide further cooling. The above mentioned components are supported and positioned in a carrying structure.

Additionally, Drager teaches an apparatus that is used constantly over long periods of time rather than emergency situations that are short in comparison and is not collapsible to conveniently fit on the belt of the user and be worn until it is needed. Drager teaches the use of tubes to supply connection means that feed the coolant across the back of the user. The material around the tubes assists or increases the cooling effects from the coolant tubes. Unfortunately, if heat were present in the Drager apparatus, the material would increase the distribution of it.

Accordingly, it is an object of the invention to provide a respirator device where the ambient temperature is reduced substantially between respirator surface and the chest of the carrier by means of a space-saving device.

SUMMARY OF THE INVENTION

The advantages achieved by this invention are specifically based on an optimum heat level obtaining between the respirator and the chest area. This is accomplished by the here disclosed configuration and positioning of a spacing body on the respirator bag surface.

According to the invention, what is claimed is a self-contained, personal breathing apparatus adapted for emergency use, including a canister, a supply of an oxygen-evolving chemical in the canister which is adapted to react with the carbon dioxide and water vapor in exhaled breath to generate oxygen, a flexible breathing bag having an input port and output port, and a mouthpiece connected to a breathing tube operably connected to the breathing bag, and a carrying strap to permit portability of the apparatus and which is further provided with: a pair of spaced apart loops that are horizontally aligned and affixed to a first vertical face of the apparatus; a means for physically spacing the apparatus from the chest of a user, further comprising an essentially flat first plate adapted to rest against the breathing bag; a pair of flanged protrusions oppositely affixed to the vertical edges of the first plate and being sized to removably engage with the loops; a second plate also having a substantially rectangular configuration and being adapted to rest against the chest of the user; a separation means disposed between the first and second plates to define a vertical passage between them; and, a pair of substantially parallel walls joining the vertical edges of the parallel plates to define a rectangular enclosure that is open at the upper and lower ends.

DETAILED DESCRIPTION OF THE INVENTION

Figure 1:
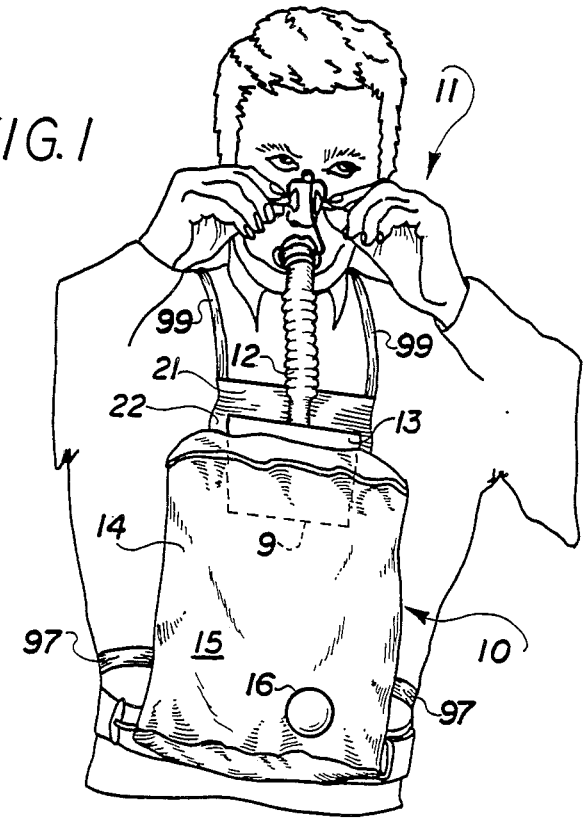
FIG. 1 is a perspective front view of the respirator in carrying position on a user to be protected.

Referring now to FIG. 1, the apparatus, generally 10, is seen in a carrying position about the waist of a user 11. The breathing tube 12 (usually ribbed for durability) extends from the user's mouth (being retained by clenching a mouthpiece not seen behind the denture). The tube terminates at the upper surface of an integrated cover (not seen) for the internal chemical unit that is housed in a canister 9. The canister 9 is retained by an adjustable peripheral rigid clamp 13. The canister 9 is submerged in the flexible breathing bag 14, which has disposed on its outer surface 15 a one-way pressure relief valve 16. The apparatus 10 is held in place on the user 11 by strap 97 that wraps around the waist of the user 11 and strap 99 that wraps around the neck of the user 11. The strap 97 is attached to the breathing bag 14, with, for instance, a clamp or tie (not shown), as is well known in the art. Similarly, the two sides of the strap 99 is attached to the rectangular planar surface 21, by, for instance, glue or staple (not shown) as is well known in the art.

Figure 2:
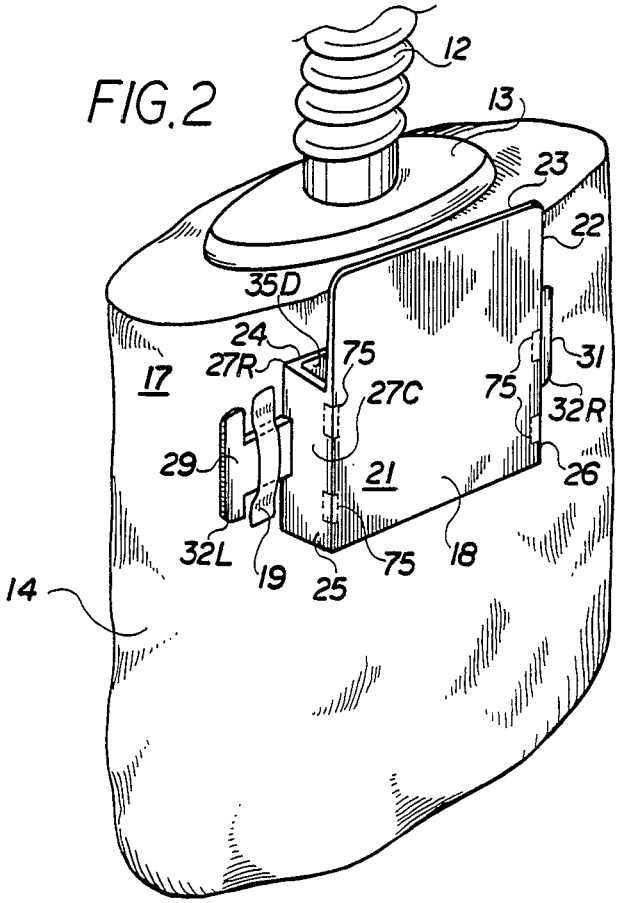
FIG. 2 is a perspective back view of the respirator with appended spacer body serving as an insulator against conduction of heat to the body of the carrier.

As depicted in FIG. 2, disposed on the obverse face 17 of bag 14 is a rigid box-like structure, generally 18, which serves to insulate the chest of the user from exposure to the high sensible heat being generated by the respirator during operation, while maintaining the respirator properly disposed under the chin of the user and necessarily resting on the user's chest.

A pair of spaced apart, fabric loops 19 (only the left one is seen), are vertically aligned on respirator face 17, being conventionally affixed thereto be sewing, or the like. An essentially rectangular planar surface 21 forms the outer side of spacer 18, which abuts the chest (not seen) of the user. The vertical dimension 22 of surface 21 exceeds the width dimension 23, so that the upper chest and throat area will be screened from exposure to the heat arising from the respirator. A parallel planar surface 24 is spaced apart from plate 21, thereby defining a vertical passage 35 between plates 21 and 24. These opposing surfaces are maintained firmly apart by vertical walls 25 and 26, which join the vertical edges of the two plates. To permit collapsibility of the spaced apart plates, the four vertical corners 27 C and R and 28C and R (seen in FIG. 3) are of a flexible, hingelike design when the respirator is out of use and to provide compactness during wearing. This hinge-like design can be for instance hinges 75 placed between the edges and corners that form the rigid box-like structure 18. The forward edges of ribs 34, 36 and 37 make locking contact with plate 21 by each edge having a piece of tape connecting it to plate 21. As the spacer is opened, the edges turn onto the plate and become flush with it, making locking contact. This is well known in the art. Appended intermediate to the length of vertical corner 27R is one of a pair of flanged protrusions 29 (the opposing member 31 extends from the other end and corner 28C is better seen in FIG. 3). The flange portions 32R and 32L are sized to loosely slip through loop 19, (on both sides), and to removably anchor to the chest of the user. The other important feature of the inventive spacer means will now be described in relation to FIG. 3.

It will be seen that a separation means, generally 33, is disposed normal to and is interposed between parallel surfaces 21 and 24. A centrally located rib 34 is also hingeably connected at both its vertical edges 34C and 34R between the plates, as are end walls 25 and 26. Standing alone, they would bridge the surfaces but will normally maintain them in a collapsed position and abutting one another. As to material of construction, spaces mean 33 can be fabricated of a silicone polymer material.

In order to assure that the vertical passages 35A, 35B, and 35C and 35D are open during respirator use, disposed on either side of central rib 34 are a pair of ribs 36 and 37. As for the offset ribs 36 and 37, these are differently configured with their backward edges 38 and 39, hingeably secured to chest-side surface 21, but having their forward edges 41 and 42 as free-standing. They are adapted to lock these members into vertical ridges 43 and 44, provided in the respirator-side surface 24 when the spacer means is to be in the operative stance. This is best seen in the broken out portion of surface 24.

Figure 3:
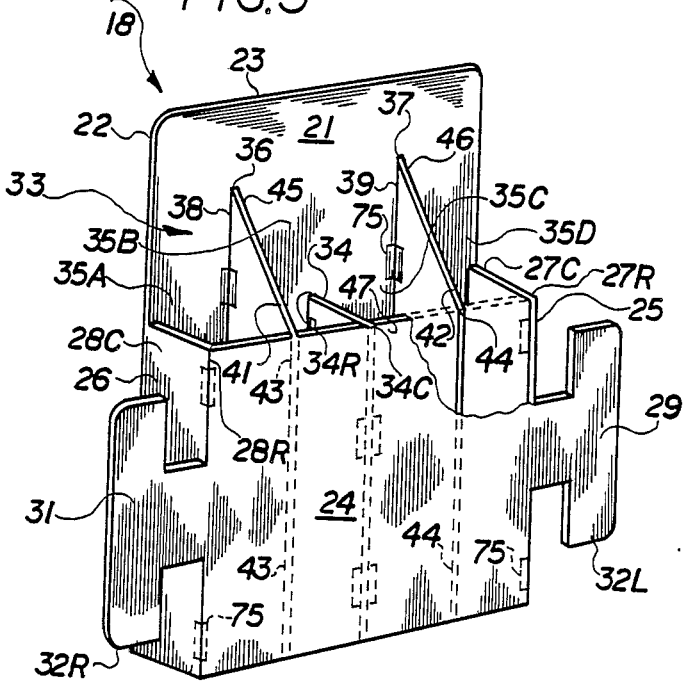
FIG. 3 is a perspective drawing of the space body of the present invention.

The resulting extended and locked ribs 36 and 37 will appear as shown in FIG. 3. This novel configuration permits positive locking apart of the opposing plates 21 and 24 without the use of adhesives permanently fixing in place the box-like structure 18, and also provides adequate strength from the 90° hinged axis to maintain the separation during use.

Ribs 36 and 37 have another distinguishing feature in the outwardly taper upper edges 45 and 46, that interface between the chest surface 21 and the respirator surface 24. They extend above the upper edge 47 of the latter. These ribs thus provide more lateral support for the area of plate 21 which extends above horizontal edge 47.

It is therefore made possible that the separation means 33, which is attached as described on the outside of the respirator 14, insures a snug fit for the breathing apparatus in the stand-by unit by simply folding it up when not required. It also has retractability in its working position, when the spacer is serving to function as an insulation means against heat transfer to the skin of the user.

What is claimed is:

1. In a self contained personal breathing apparatus for emergency use having a breathing bag with an external surface, the apparatus including a canister, a supply of oxygen-evolving chemical in the canister which is adapted to react with carbon dioxide and water vapor in exhaled breath to generate oxygen and heat as a byproduct, the breathing bag being composed of a flexible material, wherein the a canister is partially disposed therein, said canister including a first port exterior of said bag and a second port in fluid communication with said bag such that the generated oxygen collects therein, a mouthpiece, a breathing tube operably connected between the mouthpiece and the first port, such that exhaled breath is provided to the canister through the breathing tube and oxygen generated in the canister is provided for inhaled breath back through the tube, and carrying strap means to permit portability of the apparatus by a user, the improvement comprising:

a pair of spaced part loops that are aligned and affixed on the external surface of the breathing bag;

an essentially flat first plate having a substantially rectangular configuration with a first and second edge, said first and second edge being essentially parallel and opposite each other on the plate;

a first flanged protrusion affixed to the first edge, and a second flange protrusion affixed to the second edge and oppositely affixed to the first flanged protrusion, said first and second flanged protrusions being sized to removably engage with the loops on the breathing bag so the first plate is held by the loops and rests against the external surface of the breathing bag;

a second essentially flat plate also having a substantially rectangular configuration with a first and second edge;

a separation means disposed normal to and interposed transversely between said first and second plates to maintain a passage therebetween so air can flow therethrough and provide thermal insulation due to convection between the first plate and the second plate so the amount of heat byproduct is minimized from reaching the second plate and thus a user is protected therefrom, the second plate positioned by the separation means so it is parallel to the first plate with the first edge of the first plate essentially aligned and parallel to the first edge of the second plate; and a first wall and a second wall being substantially parallel to each other, said first wall joining the first edge of the first plate to the first edge of the second plate, said second wall joining the second edge of the first plate with the second edge of the second plate to define a substantially rectangular configuration for the passage within the separation means, each wall hingeably connected along their respective edges to the respective plates.

2. In a self-contained, personal breathing apparatus adapted for emergency use, including a canister, a supply of an oxygen-evolving chemical in the canister which is adapted to react with the carbon dioxide and water vapor in exhaled breath to generate oxygen and heat as a byproduct, a flexible breathing bag wherein the canister is partially disposed therein, said canister including a first port exterior of said bag and a second port in fluid communication with said bag such that the generated oxygen collects therein, a mouthpiece, a breathing tube operably connected between the mouthpiece and the first port, such that exhaled breath is provided to the canister through the breathing tube and oxygen generated in the canister is provided for inhaled breath back through the tube, and carrying strap means to permit portability of the apparatus by a user, the improvement comprising:

a pair of spaced apart loops that are aligned and affixed on the external surface of the breathing bag;

an essentially flat first plate having a substantially rectangular configuration with a first and second edge, said first and second edge being essentially parallel and opposite each other on the plate;

a first flanged protrusion affixed to the first edge and a second flanged protrusion affixed to the second edge and oppositely affixed to the first flanged protrusion, said first and second flanged protrusions being sized to removably engage with the loops on the breathing bag so the first plate is held by the loops and rests against the external surface of the breathing bag;

a second essentially flat plate also having a substantially rectangular configuration with a first and second edge;

a separation means disposed normal to and interposed transversely between said first and second plates to maintain a passage therebetween so air can flow therethrough and provide thermal insulation due to convection between the first plate and the second plate so the amount of heat byproduct is minimized from reaching the second plate and thus a user is protected therefrom, the second plate positioned by the separation means so it is parallel to the first plate with the first edge of the first plate essentially aligned and parallel to the first edge of the second plate and the second edge of the first plate essentially aligned and parallel to the second edge of the second plate; and a first wall and a second wall being substantially parallel to each other, said first wall joining the first edge of the first plate to the first edge of the second plate, said second wall joining the second edge of the first plate with the second edge of the second plate to define a substantially rectangular configuration for the passage within the separation means, each wall hingeably connected along their respective edges to the respective plates.

3. An apparatus as described in claims 1 or 2 wherein the first edge and the second edge of the first plate are of the same length and the first edge and the second edge of the second plate are of the same length, with the first edge and second edge of the first plate being of greater length than the first edge and second edge of the second plate.

4. An apparatus as described in claim 3 wherein the separation means is comprised of a first rib and a second rib spaced apart and essentially parallel to each other and to the first and second walls, each rib having a first and second edge, each rib hingeably connected along their respective second edge to the second plate, and means for locking each rib in contact with the first plate along their respective first edge to hold the plates apart such that said first and second ribs define chambers within the passage which permit atmospheric air convection between the first and second plates.

* * * * *